US008064854B2

(12) United States Patent
Yoshida et al.

(10) Patent No.: US 8,064,854 B2
(45) Date of Patent: Nov. 22, 2011

(54) DEVICE AND METHOD OF RADIO WAVE TRANSMISSION

(75) Inventors: Koji Yoshida, Obu (JP); Takao Kuroda, Nagoya (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 1100 days.

(21) Appl. No.: 11/898,111

(22) Filed: Sep. 10, 2007

(65) Prior Publication Data

US 2008/0064345 A1 Mar. 13, 2008

(30) Foreign Application Priority Data

Sep. 12, 2006 (JP) ..... 2006-246954

(51) Int. Cl.
*H01Q 11/12* (2006.01)

(52) U.S. Cl. ..... 455/127.1; 455/127.2; 455/41.1; 455/41.2; 455/96; 455/99; 340/5.26; 340/442; 340/825.69

(58) Field of Classification Search ..... 455/41.1, 455/41.2, 42, 95–99, 127.1, 127.2, 522; 340/4.1, 340/5.2–5.28, 5.6–5.65, 5.7–5.72, 825.69, 340/426.16, 426.17
See application file for complete search history.

(56) References Cited

U.S. PATENT DOCUMENTS

| | | | | |
|---|---|---|---|---|
| 6,281,599 | B1 | 8/2001 | Murakami et al. | |
| 6,665,525 | B2 * | 12/2003 | Dent et al. | 455/108 |
| 7,102,525 | B2 | 9/2006 | Cuperus et al. | |
| 7,113,072 | B2 * | 9/2006 | Endo | 340/5.26 |
| 7,493,091 | B2 * | 2/2009 | Matsuura et al. | 455/91 |
| 2003/0032397 | A1 | 2/2003 | Kuechler et al. | |
| 2004/0066231 | A1 * | 4/2004 | Masudaya | 330/251 |
| 2004/0099744 | A1 | 5/2004 | Cuperus et al. | |
| 2004/0169582 | A1 * | 9/2004 | Endo | 340/5.26 |
| 2006/0132325 | A1 * | 6/2006 | Fujii et al. | 340/825.69 |
| 2006/0215028 | A1 * | 9/2006 | Abe et al. | 348/148 |
| 2007/0129032 | A1 * | 6/2007 | Matsuura et al. | 455/127.2 |
| 2008/0129477 | A1 * | 6/2008 | Takahashi et al. | 340/442 |

FOREIGN PATENT DOCUMENTS

| | | |
|---|---|---|
| EP | 1 538 036 | 6/2005 |
| JP | 5-122087 | 5/1993 |
| JP | 10-271170 | 10/1998 |
| JP | 11-071948 | 3/1999 |
| JP | 2000-17916 | 1/2000 |
| JP | 2001-115698 | 4/2001 |
| JP | 2005-163453 | 6/2005 |

OTHER PUBLICATIONS

German Official Action dated May 21, 2008 issued in corresponding German Appln. No. 10 2007 043 124.6 with English translation.
Japanese Office Action dated Sep. 24, 2010 issued in corresponding Japanese Application No. 2006-246954 with English Translation.

* cited by examiner

*Primary Examiner* — Junpeng Chen
(74) *Attorney, Agent, or Firm* — Nixon & Vanderhye PC

(57) ABSTRACT

In a transmitter device of a smart entry system for a vehicle, a transmitter antenna is provided between a variable power circuit and the ground, and is controlled by a switching circuit to transmit a searching radio wave. The transmission power of the antenna, that is, a range of reach of the searching radio wave is variably controlled by a drive output voltage applied to the antenna by a variable power circuit, which converts a battery voltage to the drive output voltage. Data to be transmitted in the searching radio wave is not used to modulate the drive output voltage but is used in an ON/OFF control of the switching circuit.

13 Claims, 9 Drawing Sheets

24
VB
R
24b
24d
Vamp
24c
AMP
24a
24e
Vref
Vcc2 (5V)
MODULATOR
11
DRIVER
22
CHARGE PUMP
23
VARIABLE Vcc1
20
251
252
253
254
25
261
R
262
R
210
210a
210b
211
212
X
Y VB
VB
R
24b
24e
Vref
24a
AMP
24c
Vamp
24d
24
Vcc2 (5V)
MODULATOR
11
CHARGE PUMP
23
DRIVER
22
VARIABLE Vcc1
251
252
25
20
261
R
210a
210
211
212
X
Y
210b

DEVICE AND METHOD OF RADIO WAVE TRANSMISSION

CROSS REFERENCE TO RELATED APPLICATION

This application is based on and incorporates herein by reference Japanese Patent Application No. 2006-246954 filed on Sep. 12, 2006.

FIELD OF THE INVENTION

The present invention relates to a device and method of radio wave transmission.

BACKGROUND OF THE INVENTION

In recent years, various electronic key systems such as a smart entry system are used in vehicles. In these systems, a vehicle-mounted device performs radio communication with a portable device (electronic key) carried by a user to verify ID of the portable device and control locking/unlocking of vehicle doors in response to commands from the portable device.

JP 11-71948A discloses a vehicle-side transmitter device suitable for such electronic key systems. This transmitter device variably sets a range of reach of a radio wave (searching radio wave), which is transmitted in search for a portable device. This transmitter device has an oscillator for generating a fixed output of a transmission carrier wave signal, and a signal amplifier for converting the oscillator output to a radio wave to be outputted from an antenna. For adjusting the output level of the radio wave to variably set the range of reach of the radio wave, the following two methods are proposed: (A) adjustment of the output of the signal amplifier by a variable resistor provided at an output stage of the signal amplifier; and (B) adjustment of a gain of the signal amplifier.

According to any of the methods (A) and (B), a large output type amplifier is required so that its output is directly used to drive the antenna. According to the method (A), the variable resistor causes poor power efficiency because of power loss, particularly in low power side. According to the method (B), because even a small variation in an input signal is amplified, the amplitude of the radio wave transmitted from the antenna is varied by an operation characteristic or temperature characteristic of the signal amplifier, thus resulting in unstable operation.

SUMMARY OF THE INVENTION

The present invention therefore has an object to provide a device and a method of radio wave transmission, which is capable of stably maintaining a radio wave output transmitted from an antenna and variably setting a range of reach of the radio wave.

According to the present invention, in a vehicle-side device, a variable power circuit produces a drive output voltage from a battery voltage, a modulation circuit modulates a carrier wave signal of a carrier frequency by a baseband signal of a frequency lower than the carrier frequency to thereby produce a switching control signal, and a switching circuit switches on and off an application of the drive output voltage to an antenna in response to the switching signal. The variable power circuit sets the drive output voltage to variably set a range of reach of a radio wave transmitted from the antenna, so that the radio wave may be received by a portable device entering the range of reach.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EMBODIMENT

Figure 1:
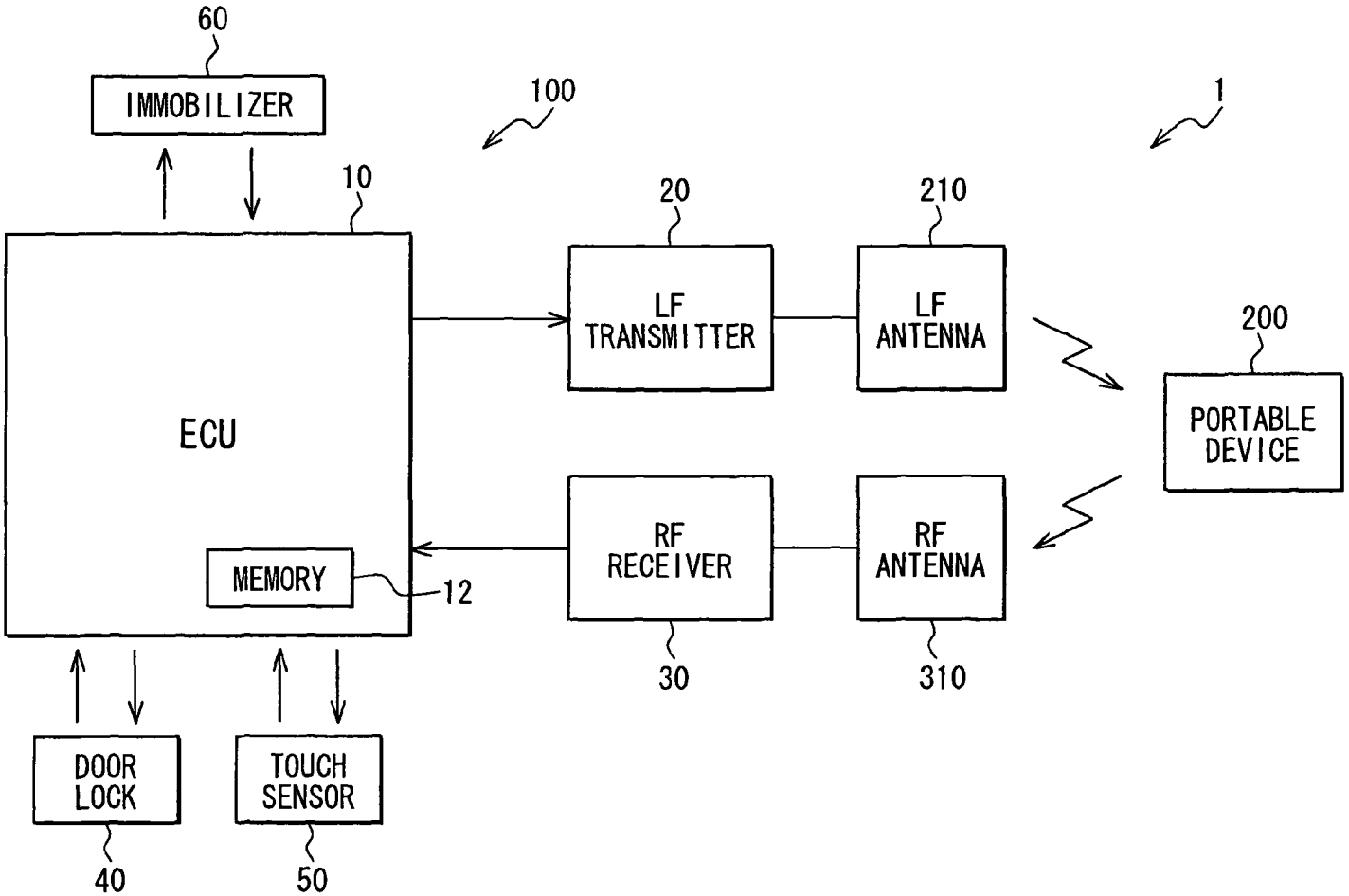
FIG. 1 is a block diagram showing a radio locking/unlocking system of a vehicle using a LF transmitter device according to the present invention.

Referring first to FIG. 1, a radio locking/unlocking system 1 includes a vehicle-side device 100 mounted on a vehicle, and a portable device 200 carried by a user. The portable device 200 stores therein an identification (ID) code, which is specific to each vehicle, and performs radio communication with the vehicle-side device 100. The vehicle-side device 100 checks whether the portable device 200 specific to the vehicle is present within a predetermined range from the vehicle by the ID code, and performs predetermined control (e.g., door locking/unlocking, immobilizer unlocking, etc.) based on the check result of ID code. The vehicle-side device 100 includes an electronic control unit (ECU) 10, a low frequency (LF) transmitter device 20 connected to the ECU 10 and a LF antenna 210, and a radio frequency (RF) receiver device 30 connected to the ECU 10 and a RF antenna 310.

The LF transmitter device 20 modulates a LF carrier wave signal by a baseband signal including a portable key ID code and the like, and periodically transmits a polling wave from the LF antenna 210. The power of the polling wave is determined so that the polling wave can reach the predetermined range. If the portable device 200 is present within the predetermined range, the portable device 200 receives the polling wave and demodulates the baseband signal. If the demodulation result indicates that the polling wave is specific to the portable device 200 itself, the portable device 200 automatically transmits in return a RF response wave including its ID code.

At the vehicle-side device 100, the RF receiver device 30 receives this RF response wave through the RF antenna 310, and demodulates a baseband signal of the RF response wave including the ID code. The ECU 10 checks whether the ID code in the RF response wave corresponds to a master ID code stored in a memory 12. If the check result indicates that both ID codes correspond to each other, the ECU 10 controls operations of a door lock device 40 and an immobilizer device 60. For instance, a user carrying the portable device 200 touches a door knob, the ECU 10 receives an output signal of a touch sensor 50 provided on the door knob and validates this output signal as a touch of an authorized user. The ECU 10 then issues a command to the door lock device 40 to lock or unlock the door.

The LF transmitter device 20 is fixed at a predetermined position in the vehicle so that it may transmit the polling wave for portable device searching. The output power of the polling wave defines the predetermined range of searching for the portable device 200.

Figure 2:
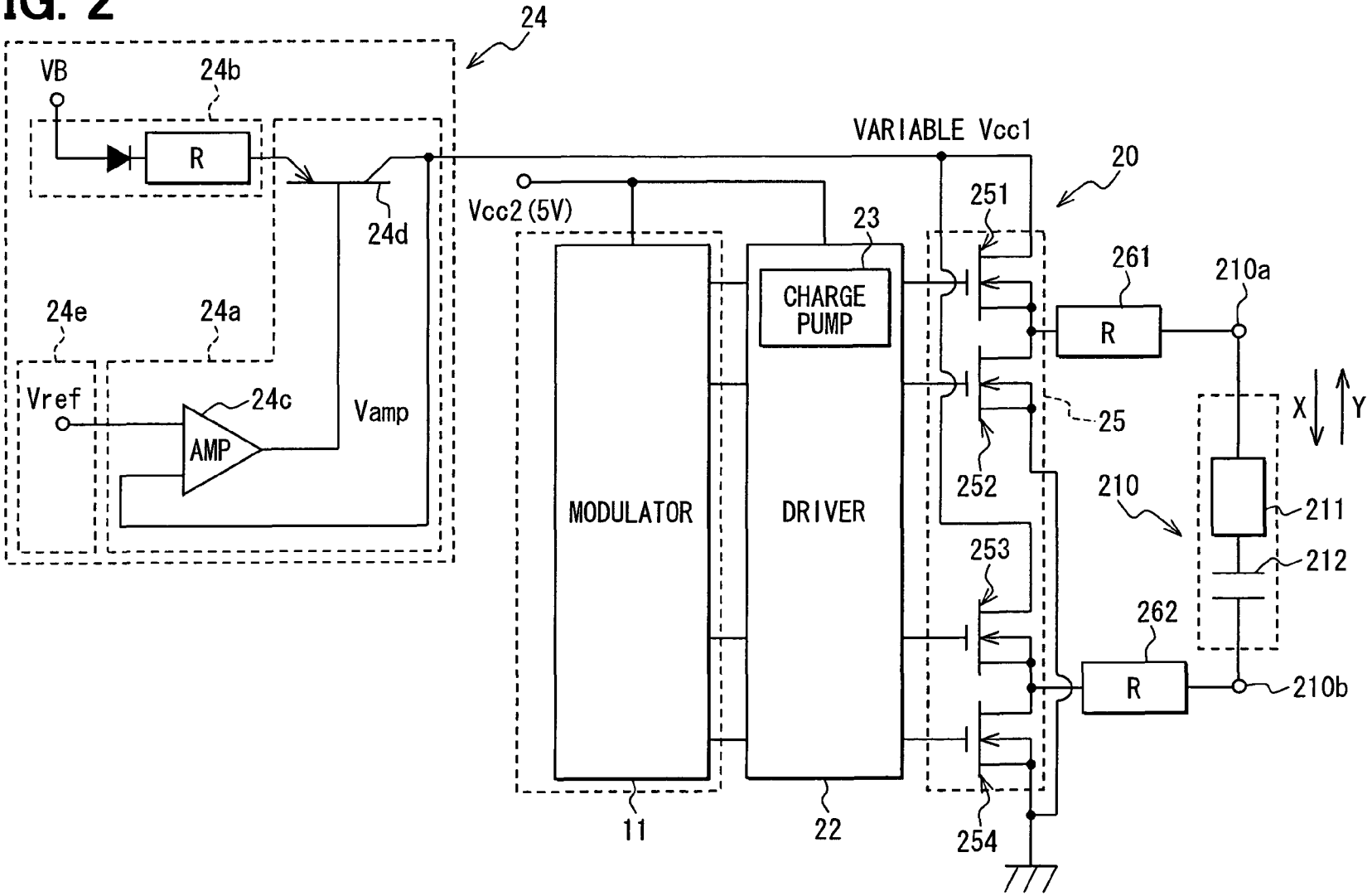
FIG. 2 is a block diagram showing one embodiment of the LF transmitter device shown in FIG. 1.

As shown in FIG. 2, the LF transmitter device 20 includes a variable power circuit 24, a switching circuit 25, a driver circuit 22, and a modulator circuit 11. The variable power circuit 24 receives electric power VB from a vehicle-mounted battery (not shown) and supplies a drive output voltage Vcc1 to drive the LF antenna 210. The switching circuit 25 is provided between the variable power circuit 24 and the LF antenna 210 to switch over the direction of power supply between two directions X and Y. The direction X is from a first terminal 210*a* to a second terminal 210*b*, and the direction Y is from the second terminal 210*b* to the first terminal 210*a*. The driver circuit 22 includes a charge pump circuit 23, and drives the switching circuit 25 based on a carrier wave frequency of the searching radio wave. The modulator circuit 11 modulates a switching driver output of the driver circuit 22 in on/off manner based on a digital baseband signal of a frequency lower than the carrier wave frequency.

The variable power circuit 24 is for variably setting a range of reach of the searching radio wave, and includes a voltage converter circuit 24*a*, a battery voltage input circuit 24*b* and a command input circuit 24*e*. The command input circuit 24*e* inputs a reference voltage Vref as a variable command indicating a drive output voltage Vcc1, which should be applied to the LF antenna 210. The voltage converter circuit 24*a* includes an amplifier and a switching transistor 24*d*, and converts the battery voltage VB to the drive output voltage Vcc1 in accordance with the variable command.

The LF antenna 210 is a resonant antenna, which includes an antenna coil 211 and a capacitor 212 coupled to make a series resonance. The driver circuit 22 switching-drives the switching circuit 25 in accordance with the carrier wave frequency, which corresponds to a resonant frequency of the LF antenna 210. Although the LF antenna 210 is directly driven in pulse (on/off) waveform, it generates a carrier wave in a resonant sine waveform. As a result, higher harmonic components, which are included in the pulse waveform and causes noise and electromagnetic interference (EMI), can be effectively reduced. Further, because of a resonant circuit configuration, the winding length of the antenna coil 211 is far shorter than a transmitted wave length and effective to reduce the antenna size. As one example, the band width of the transmission wave is set to a LF band, that is, from 50 kHz to 500 kHz, of a long wavelength. Further, the LF band is advantageous in that the portable device 200 does not respond to the searching radio wave, when the user (portable device) is away from the predetermined range. It is also advantageous in that the portable device 200 respond to the searching radio wave wherever it is carried by the user, because the searching radio wave easily propagates.

The switching circuit 25 is formed as a H-bridge circuit of four (first to fourth) switching transistors 251 to 254, and connected to the LF antenna 210 through impedance matching resistors 261 and 262. The first switching transistor 251 is provided between the variable power circuit 24 and the antenna terminal 210*a*. The second switching transistor 252 is provided between the antenna terminal 210*a* and the ground. The third switching transistor 253 is provided between the variable power circuit 24 and the antenna terminal 210*b*. The fourth switching transistor 254 is provided between the antenna terminal 210*b* and the ground. The antenna 210 is supplied with electric power in the first direction X, when the first and the fourth switching transistors 251 and 254 are turned on and the second and the third switching transistors 252 and 253 are turned off. The antenna 210 is supplied with electric power in the second direction Y, when the first and the fourth switching transistors 251 and 254 are turned off and the second and the third switching transistors 252 and 253 are turned on. The switching circuit is also shown in FIG. 4.

Figure 3:
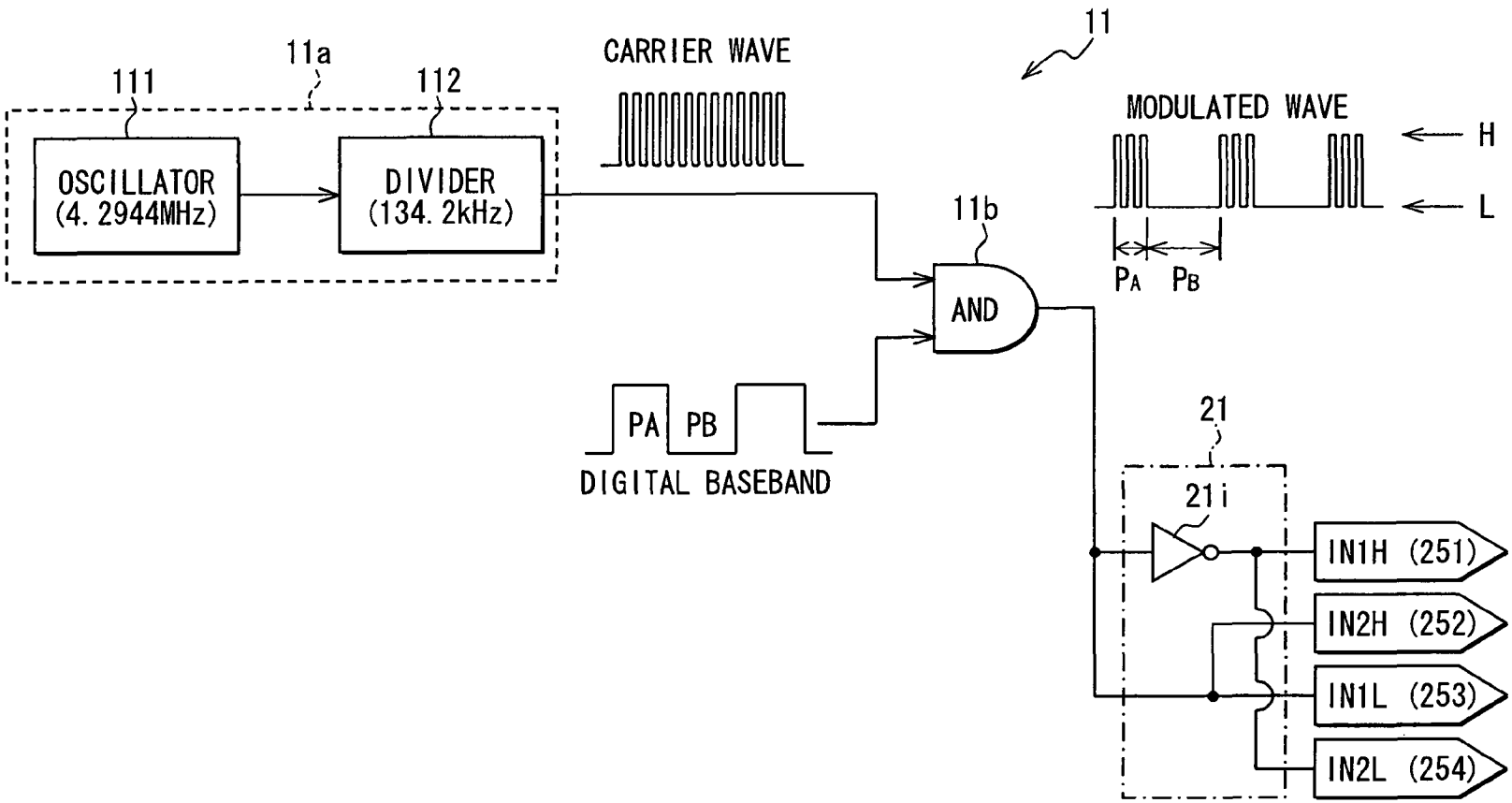
FIG. 3 is a schematic diagram showing a modulation circuit shown in FIG. 2.

As shown in FIG. 3, the modulator circuit 11 includes a carrier wave signal circuit 11*a*, a modulation circuit 11*b* and a logic circuit 21. The carrier wave signal circuit 11*a* includes a reference oscillator circuit 111 and a frequency divider circuit 112, and produces a pulse-shaped carrier wave signal corresponding to the carrier wave frequency by dividing in frequency a reference clock signal of the reference oscillator circuit 111 by the divider circuit 112. The modulation circuit 11*b*, which may be an AND gate, subjects the carrier wave signal of the carrier wave signal circuit 11*a* and the pulse-shaped digital baseband signal of a low frequency to an AND-logic operation, and produces a modulated wave signal. The digital baseband signal has an ON-period PA and an OFF-period PB, which are varied in accordance with data to be transmitted. The modulated wave signal has a plurality of pulses in the period PA but no pulses in the period PB. The modulation circuit 11*b* may be formed by a switching transistor (e.g., FET), which is provided in the output path of the carrier wave signal.

The logic circuit 21 includes an inverter gate 21*i*, which receives the modulated wave signal and produces four input drive signals, 1N1H, 1N2H, 1N1L and 1N2L, for driving the switching transistors 251, 252, 253 and 254, respectively. Thus, the input drive signals are used as switching control signals. Specifically, when the modulated wave signal is at the high level (H) during the period PA, the switching transistors 251 and 254 are turned on by the input drive signals 1N1H and 1N2L to energize the antenna 210 in the direction X. When the modulated wave signal is at the low level (L) during the period PA, the switching transistors 252 and 253 are turned on by the input drive signals 1N2H and 1N1L to energize the antenna 210 in the direction Y. During the period PB, all switching transistors 251 to 254 are turned off.

Figure 4:
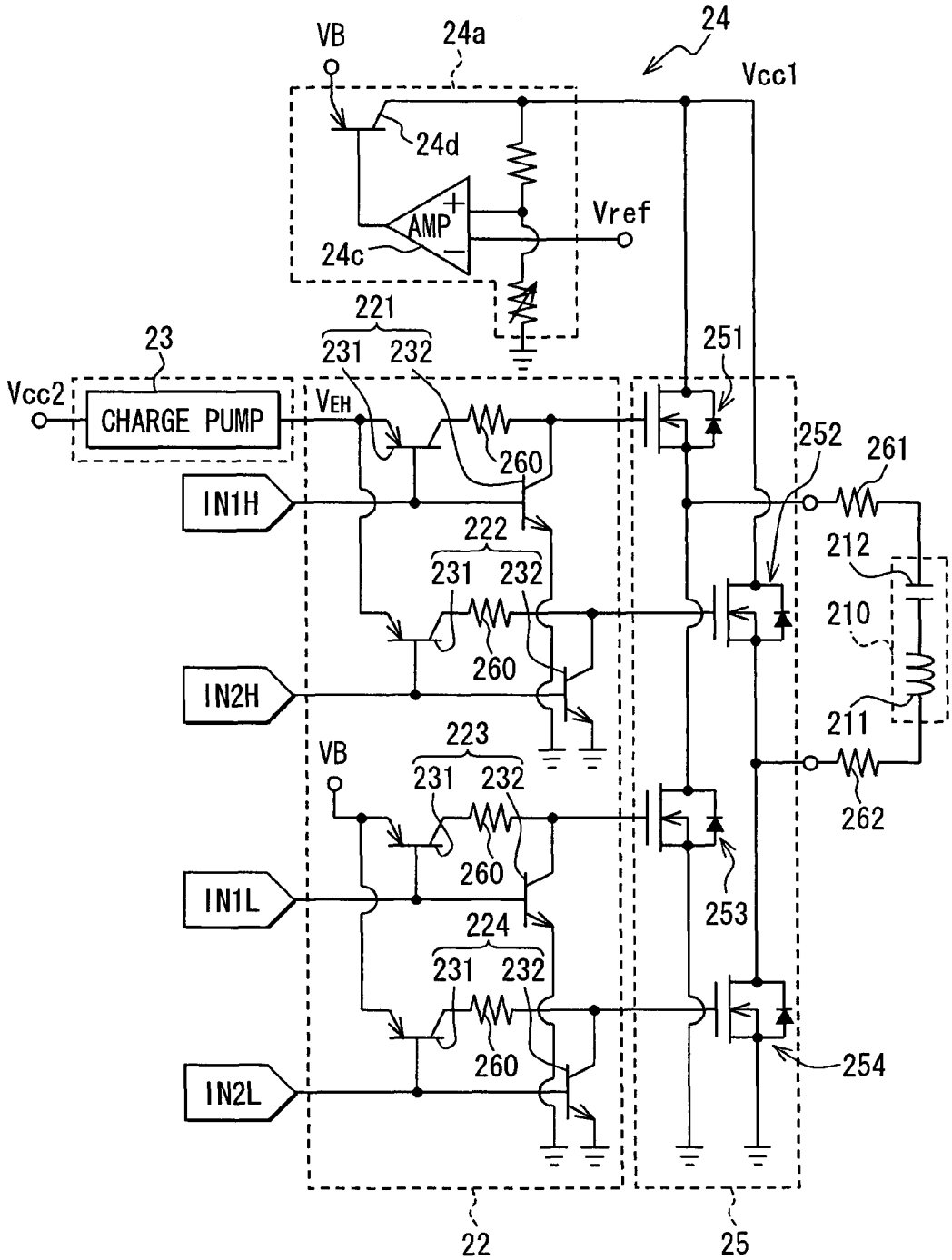
FIG. 4 is a circuit diagram showing a switching circuit and a driver circuit of the LF transmitter device shown in FIG. 2.

As shown in FIG. 4, the switching circuit 25 receives the drive output voltage Vcc1 from the variable power circuit 24 as a transmission driving voltage of the LF antenna 210. Each switching transistor 251, 252, 253, 254 may be a N-channel MOSFET, which has a source connected to the variable power circuit 24 and a drain connected to the ground or a ground side. The driver circuit 22 is connected to the gates of the switching transistors 251 to 254 to drive circuits drives includes a charge pump circuit (gate booster circuit) 23 for supplying a boosted drive voltage VEH higher than the battery voltage VB to the gate of the MOSFET 251, 252, 253 or 254, which is to be turned on to energize the antenna 210.

Each MOSFET is an enhancement type, which has a small ON-resistance and high gate input impedance, so that the switching circuit 25 may consume less electric power. It is assumed here that a source voltage, a gate voltage and a threshold gate-source voltage for turning on of a MOSFET are Vcc2, VG and Vk (about 2.5 V), respectively. In case of a P-channel type, the MOSFET turns on when the gate voltage VG is lower than the source voltage Vcc2 by more than Vk, that is, $Vcc2-VG \geqq Vk$. In case of a N-channel type, the MOSFET turns on when the gate voltage Vg is higher the source voltage Vcc2 by more than Vk, that is, $VG-Vcc2 \geqq Vk$.

The drive voltage VX (corresponding to Vcc1) to be switched is generally much higher than the signal power voltage Vcc2 (e.g., +5 V and corresponding to VG). In this case, by using P-channel MOSFETs for the high side (power circuit 24 side) and N-channel MOSFETs for the low side (ground side), it is possible to use the signal power voltage Vcc2 as the gate voltage to drive the switching circuit 25. It may however be impossible in a case, in which the transmission drive voltage VX to be switched is variable to variably set the range of reach of the radio wave. That is, in case of P-channel MOSFET at the high side, when the transmission drive voltage VX is set small for a small range, the voltage VG need be set negative to satisfy Vcc2−VG≧Vk to turn on the MOSFET at the high side. This negative voltage requires a negative power circuit.

To drive the switching circuit 25 without a negative power circuit, all the switching transistors 251 to 254 use N-channel MOSFETs. To drive the N-channel MOSFET, it is necessary to apply the gate voltage VG which is higher than the transmission drive voltage VX (source voltage Vcc2) by the threshold voltage Vk. This gate voltage VG is supplied by the charge pump circuit 23, which supplies the boosted gate drive voltage VEH. Thus, all MOSFETs can be driven without a negative power circuit irrespective of a set value of the transmission drive voltage VX. Thus, a lowermost limit Vxmin of the drive output voltage Vcc1 can be set to be lower than the gate drive voltage VEH, and the range of variation of the drive output voltage Vcc1 can be remarkably widened to a lower voltage side. For instance, with the voltage Vk being about 2.5 V, the lowermost limit Vxmin can be set to between 1.5 V and 2.5 V. As one example, the drive output voltage Vcc1 can be variably set in increment or decrement of 0.3 V between the lowermost limit Vxmin of 1.7 V and a uppermost limit Vxmax of 6.8 V.

The charge pump circuit 23 applies the gate drive voltage VEH, which is more than 2.5 V higher than the drive output voltage Vcc1 of the variable power circuit 24, to the gates of N-channel MOSFETs to be turned on, so that the MOSFETs stably perform respective switching operations. The gate drive voltage VEH may be variably set in accordance with the drive output voltage Vcc1 or may be set to a fixed level. In this instance, the fixed level (gate drive voltage VEH) must be higher than the uppermost limit Vxmax by more than the threshold voltage Vk even when the drive output voltage Vcc1 is set to the uppermost limit Vxmax. For example, Vxmax may be 6.8 V, and VEH may be between 10 V and 25V (e.g., 20V). This voltage VEH must be lower than a withhold voltage of a gate of a MOSFET used.

The charge pump circuit 23 may be replaced with a booster type DC-DC converter. However, the charge pump circuit 23 will suffice, because a MOSFET has a high gate input impedance and does not require so high output current. The charge pump circuit 23 only needs diodes, capacitors, switching transistors, and the like, and simple in construction and low in cost. Further, it can be easily integrated into a C-MOS monolithic IC with the switching circuit 25, driver circuit 25 and logic circuit 21.

Figure 5:
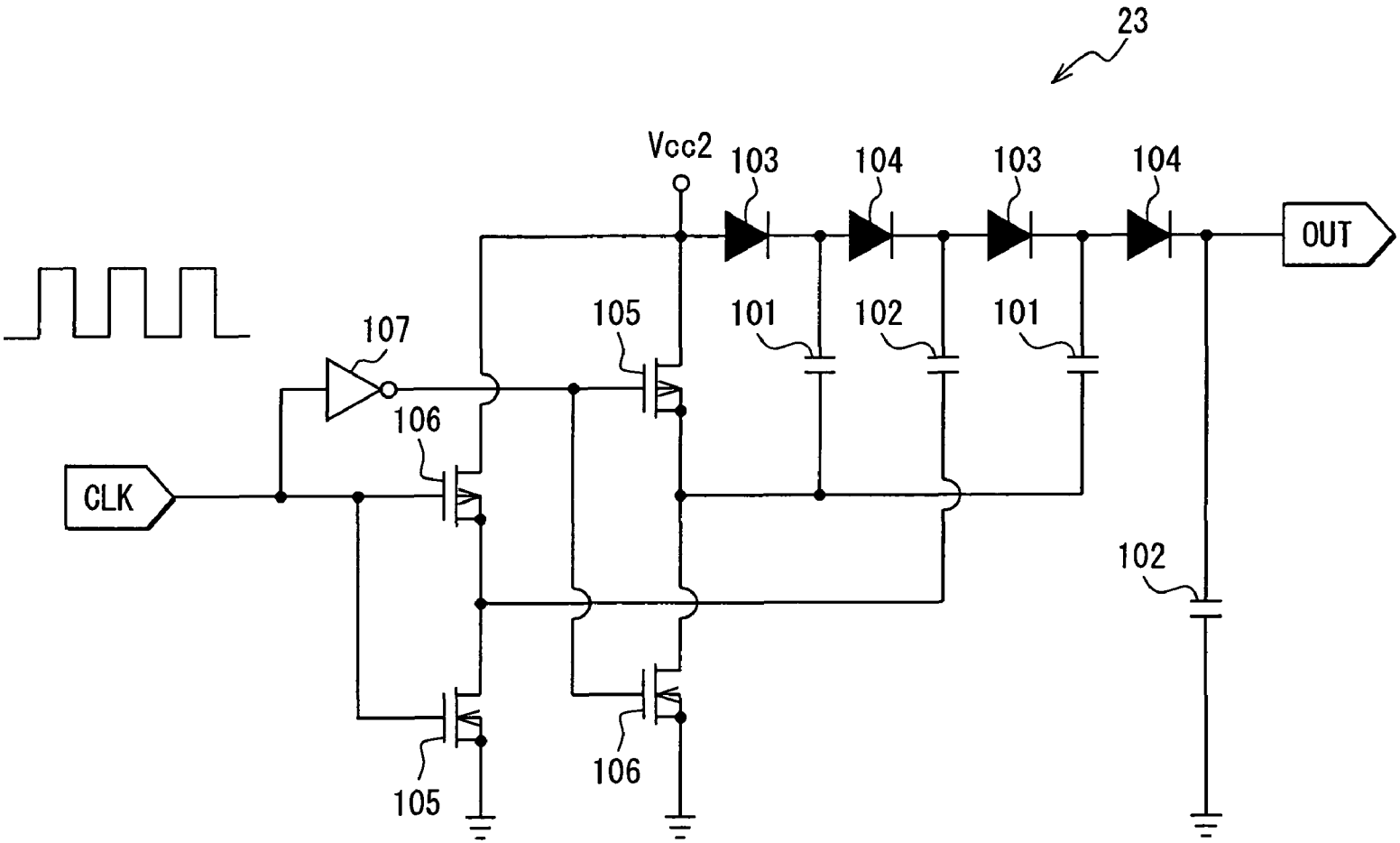
FIG. 5 is a circuit diagram showing a charge pump circuit, which forms a gate voltage booster circuit shown in FIG. 4.

More specifically, as shown in FIG. 5, the charge pump circuit 23 includes capacitors 101 and 102 for voltage multiplication, diodes 103 and 104 for preventing reverse-flow of current, switching transistors 105 and 106, and an inverter gate 107. One set (first set) of the capacitor 101 and the diode 103, and the other set (second set) of the capacitor 102 and the diode 104 are connected in series alternately. Those circuit elements are so connected that the voltage Vcc2 is multiplied in correspondence to the number of stages of the first and second sets by complementarily turning on and off the transistors 105 and 106 in response to a clock CLK.

Referring again to FIG. 4, the driver circuit 22 includes first and second input drive transistors 221 and 222, to which input signal levels 1N1H and 1N2H of opposite levels (H or L) are applied. The input voltage to the transistor 221 and 222 is set lower than the gate drive voltage VEH. Each of transistors 221 and 222 includes an ON-drive transistor 231 and an OFF-drive transistor 232. The transistors 231 are arranged between the charge pump circuit 23 and the switching transistors 251 and 252. When the transistors 231 turn on in response to respective input drive signals 1N1H and 1N2H, the gate drive voltage VEH is applied to the switching transistors 251 and 252, respectively. The transistors 232 are arranged between the gates of the switching transistors 251 and 252 and the ground. When the transistors 232 turn on in response to respective input drive signals 1N1H and 1N2H, the gate drive voltage VEH is shorted and not applied to the switching transistors 251 and 252, respectively. Thus, by providing the ON-drive transistor and the OFF-drive transistor in the driver circuit 22 for each switching transistor of the switching circuit 25, the switching transistor can be switched over between ON and OFF without fail.

The signal voltage of the logic circuit 21 is a stabilized voltage Vcc2 (e.g., 5 V) lower than the battery voltage VB, and the charge pump circuit 23 boosts this stabilized voltage Vcc2 to the gate drive voltage VEH. As a result, the gate drive voltage VEH can be stably produced relative to the stabilized voltage Vcc2 as a reference. Particularly, the charge pump circuit 23, which is a voltage multiplication circuit of a combination of diodes and capacitors, can produce the gate drive voltage VEH as an integer multiple of the stabilized voltage.

The driver circuit 22 further includes third and fourth input drive transistors 223 and 224, to which input signal levels 1N1L and 1N2L of opposite levels (H or L) are applied. The input voltage to the transistor 223 and 224 is set lower than the gate drive voltage VEH. Each of transistors 223 and 224 includes an ON-drive transistor 231 and an OFF-drive transistor 232. The transistors 231 are arranged between the battery circuit of voltage VB and the switching transistors 253 and 254. When the transistors 231 turn on in response to respective input drive signals 1N1L and 1N2L, the battery voltage VB is applied to the switching transistors 253 and 254, respectively. The transistors 232 are arranged between the gates of the switching transistors 253 and 254 and the ground. When the transistors 232 turn on in response to respective input drive signals 1N1L and 1N2L, the battery voltage VB is shorted and not applied to the switching transistors 253 and 254, respectively.

Thus, by providing the ON-drive transistor and the OFF-drive transistor in the driver circuit 22 for each switching transistor of the switching circuit 25, the switching transistor can be switched over between ON and OFF without fail. With the third and fourth transistors 223 and 224, the switching transistors 253 and 254 can be driven by the voltage Vcc2 lower than the gate drive voltage VEH. The gate drive voltage, which the ON-drive transistors 231 of the third and fourth transistor 223 and 224 control, may be produced by dividing the gate drive voltage VEH. However, since each N-channel MOSFET of the third and fourth switching transistors 253 and 254 is grounded at its source when turned on, it is possible to drive the same by the battery voltage VB. In this instance, the wiring in the driver circuit 22 is simplified.

In this embodiment, the ON-drive transistor 231 and the OFF-drive transistor 232 are connected to each other at respective bases, and is a PNP bipolar transistor and a NPN bipolar transistor, respectively. Further, the collectors of the transistors 231 and 232 are connected to each other through a current detecting resistor 260. The transistor 232 is also used to protect the gates of the switching transistors 251 to 254 from excessive currents.

The variable power circuit 24 includes the amplifier circuit 24*a*, which differentially amplifies the battery voltage VB so that a difference between the drive output voltage Vcc1 and the reference voltage Vref is reduced. In the amplifier circuit 24*a*, the transistor 24*d*, which may be a bipolar type, receives the battery voltage VB at its emitter and produces the drive output voltage Vcc1 from its collector. The amplifier 24*c* applies its differential output voltage Vamp to the base of the transistor 24 to feedback control the amplifying operation of the transistor 24*d*. Thus, the drive output voltage Vcc1 is produced in correspondence to the reference voltage Vref. The transistor 24*d* may be a FET. The amplifier 24*c* need not be a large power type, because it is only required to control an input signal (base current) of the transistor 24*d*.

The operation of the LF transmitter device 20 is described next.

In the variable power circuit 24 shown in FIGS. 2 and 4, the reference voltage Vref is variably set to determine the output power of the radio wave transmitted from the LF antenna 210, that is, the range of search for the portable device 200. The battery voltage VB is amplified and feedback-controlled to the drive output voltage Vcc1, which corresponds to the command output power indicated by the reference voltage Vref.

Figure 6:
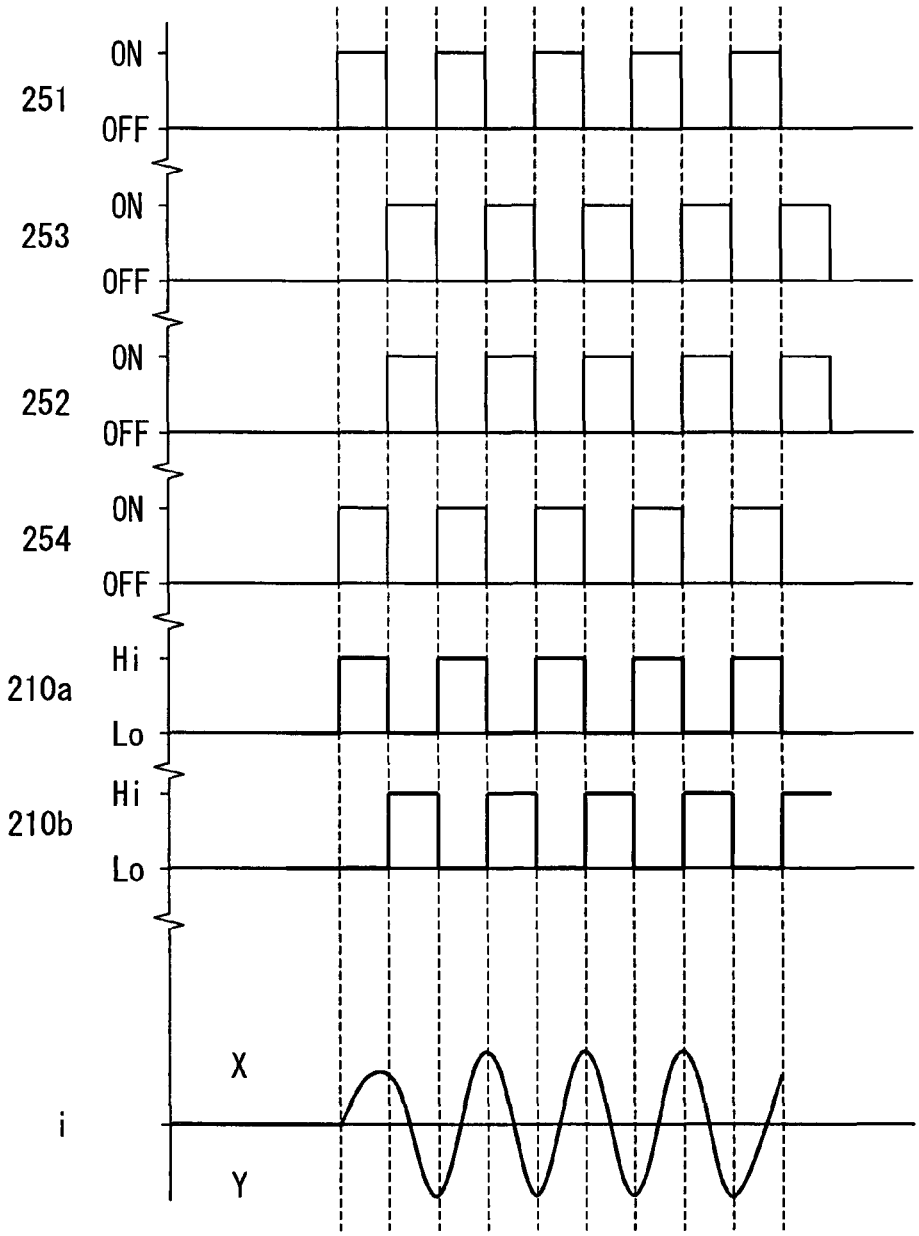
FIG. 6 is a time chart showing an operation of the LF transmitter device shown in FIG. 2.

In the modulator circuit 11 shown in FIG. 3, the digital baseband signal of periods PA and PB corresponding to a request data to be transmitted is produced in pulse form. By this baseband signal, the carrier wave signal is ON/OFF-modulated to produce the modulated wave signal. Based on this modulated wave signal, the four input drive signals 1N1H to 1N2L for the switching transistors 251 to 254 are produced as shown in FIG. 6. As a result, one set of switching transistors 251 and 254 and the other set of switching transistors 252 and 253 are turned on and off, thus alternately changing the potentials to high (Hi) and low (Lo) at the antenna terminals 210*a* and 210*b*. Thus, an alternating current i in the sine waveform of magnitude corresponding to the voltage Vcc1 flows in the LF antenna 210, which responsively transmits the searching radio wave. The LF antenna 210 does not transmit the searching radio wave when all the switching transistors 251 to 254 are turned off. Thus, digital data is transmitted by alternately performing transmission and non-transmission of the searching radio wave from the LF antenna 210 as defined by the ON-modulation period PA and the OFF-modulation period PB of the digital baseband signal.

Figure 7A:
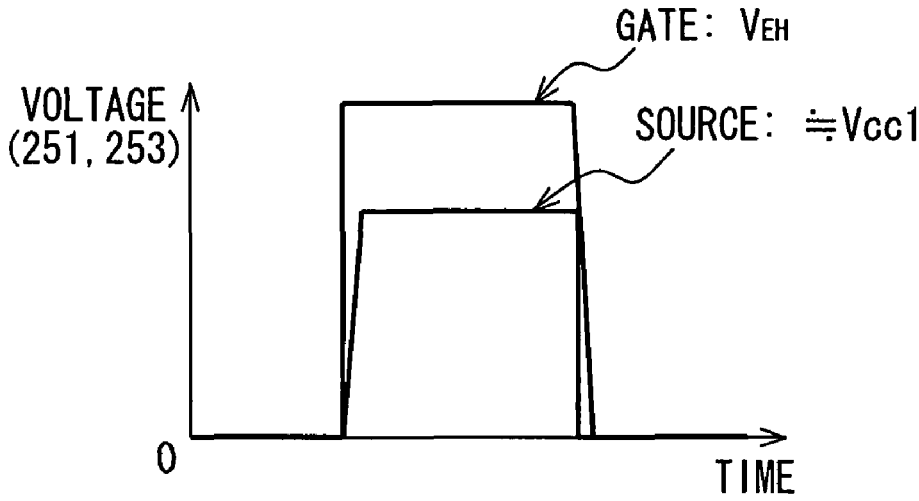
FIGS. 7A and 7B are charts showing operations of MOSFETs in the switching circuit shown in FIG. 4.
Figure 7B:
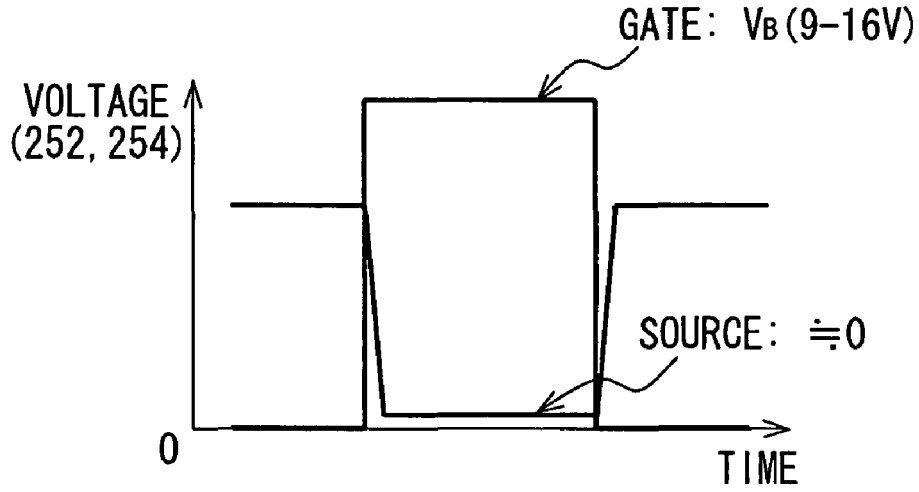

As shown in FIG. 7A, the switching transistors 251 and 253 at the high side receive the gate voltage from the charge pump circuit 23 at respective gates. When this voltage VEH becomes VEF, the switching transistors 251 and 253 turn on so that the drive output voltage Vcc1 is applied to respective sources. As shown in FIG. 7B, the switching transistors 252 and 254 at the low side receive the gate voltage from the battery at respective gates. When this voltage becomes VB, the switching transistors 252 and 254 turn on so that respective sources are grounded.

The above embodiment may be modified in various ways.

For instance, although the boosted gate voltage VEH of the charge pump circuit 23, which is fixed, is applied to the gates of the switching transistors 251 and 252, irrespective of the drive output voltage Vcc1 of the variable power circuit 24, a combined voltage (e.g., Vcc1+VEH) may be applied to the gates of the switching transistors 251 and 252. In this instance, the gate voltage is also variable with the drive output voltage Vcc1.

Figure 8:
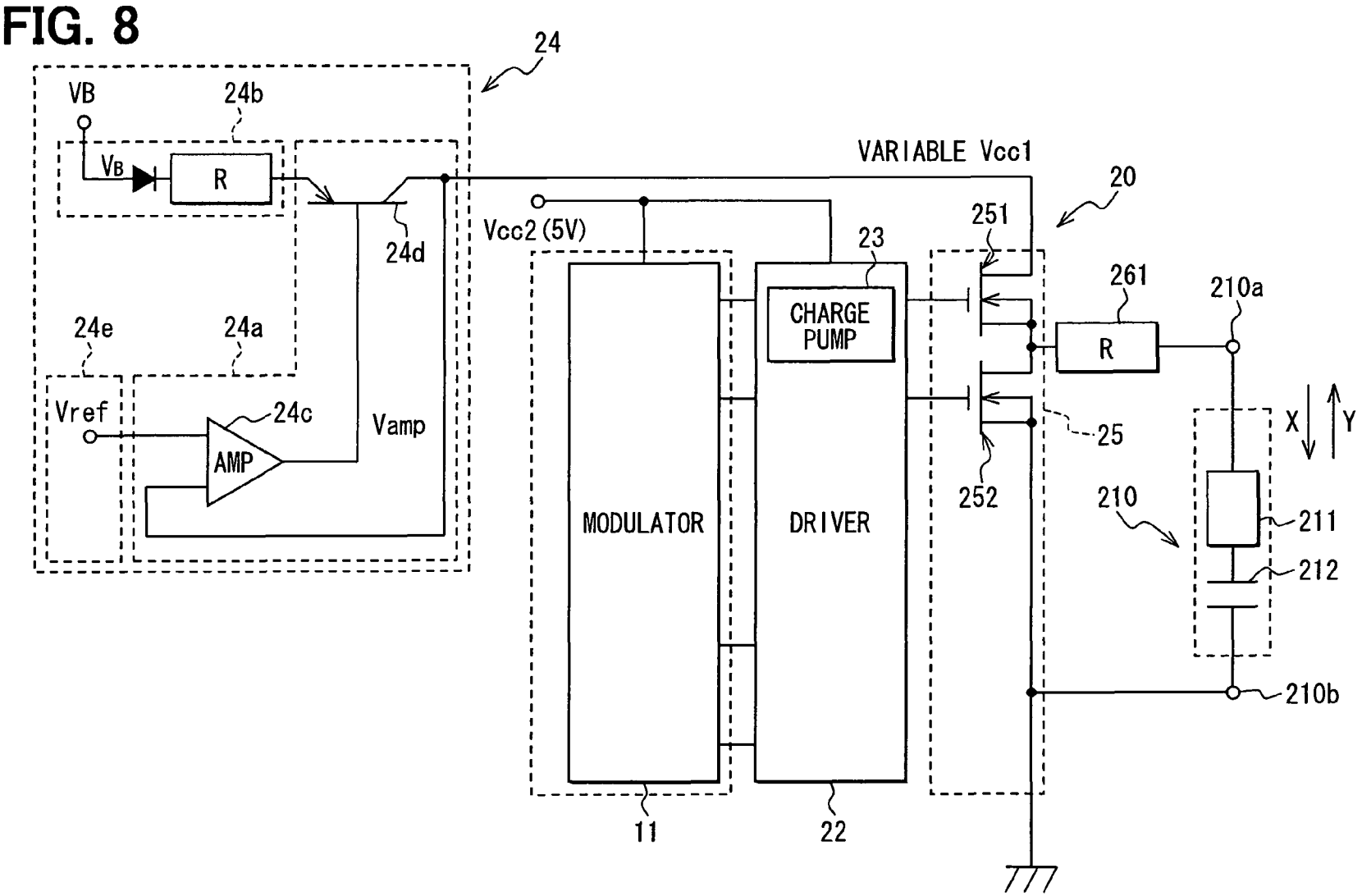
FIG. 8 is a block diagram showing another embodiment of the LF transmitter device shown in FIG. 1.
Figure 9:
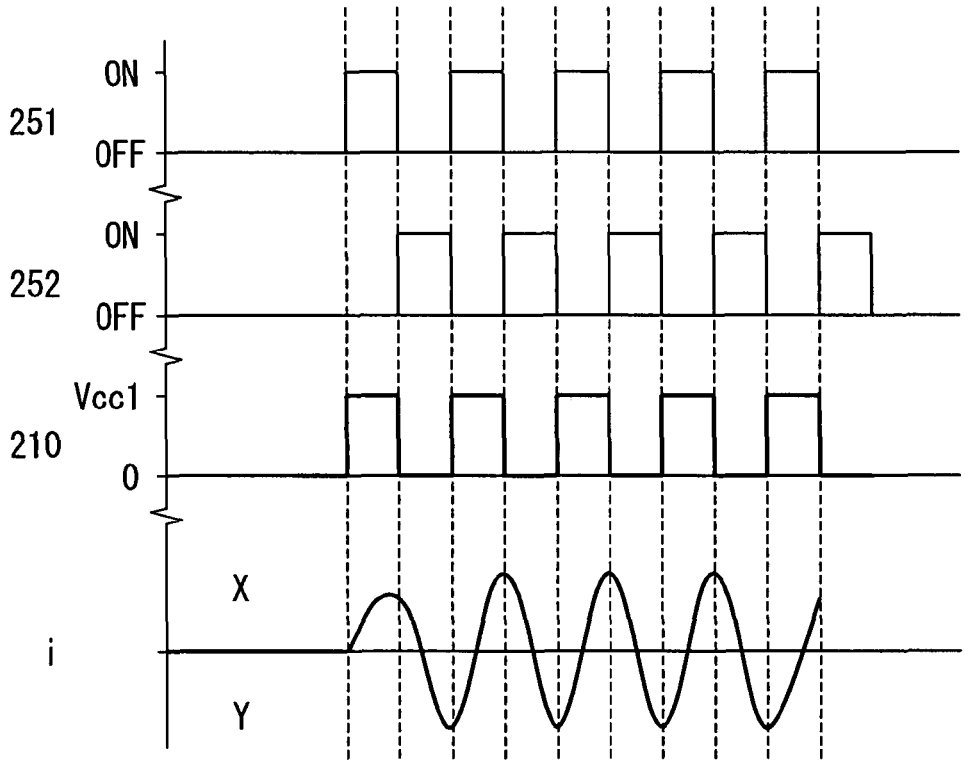
FIG. 9 is a timing chart showing an operation of the LF transmitter device shown in FIG. 8.

Although the switching circuit 25 is configured as the H-bridge circuit as shown in FIGS. 2 and 4 so that the drive output voltage Vcc1 is applied to the LF antenna 210 continuously but in opposite directions X and Y alternately, the switching circuit 25 may be constructed as shown in FIG. 8 by using only two switching transistors 251 and 252. According to this modification, the drive output voltage Vcc1 is applied to the LF antenna 210 in only one direction X but the application of the same is interrupted. Specifically, the switching circuit 25 is constructed as a half-bridge circuit of switching transistors 251 and 252. The switching transistor 251 is provided between the variable power circuit 24 and the antenna terminal 210, and the switching transistor 252 is provided between the antenna terminals 210*a* and 210*b*. Although the terminal 210 is connected to the switching circuit 25 through the resistor 261, the terminal 210 is directly connected to the ground. As shown in FIG. 9, the drive output voltage Vcc1 is applied to the terminal 210*a* of the LF antenna 210 only when the switching transistors 251 and 252 are turned on and off, respectively. However, due to resonance characteristic of the antenna 210, the current i flows in opposite directions X and Y alternately in synchronization with the switching operations. The amplitude of the current is about one half of that in the embodiment of FIG. 2, as long as the drive output voltage Vcc1 is the same.

The transmitter device may be applied to various remote control systems other than a keyless entry system for a vehicle.

What is claimed is:

1. A radio transmitter device comprising:

an antenna for transmitting a radio wave, the antenna having a first terminal and a second terminal;

a power circuit for receiving a battery voltage and supplying a drive output voltage to the antenna;

a switching circuit provided between the power circuit and the antenna for switching over a direction of application of the drive output voltage between a first direction and a second direction, which are from the first terminal to the second terminal and from the second terminal to the first terminal, respectively;

a driver circuit for driving the switching circuit in response to a carrier wave frequency of the radio wave; and a modulator circuit for modulating in an ON/OFF manner an output of the driver circuit by a digital baseband signal of a frequency lower than the carrier wave frequency, wherein the power circuit is a variable power circuit, which includes a command input circuit for inputting a command value of the drive output voltage and a voltage converter circuit for converting the battery voltage to the drive output voltage in accordance with the command value, the command value being variable so that a range of reach of the radio wave transmitted from the antenna is varied in correspondence to the command value, the switching circuit includes an H-bridge circuit of a first switching transistor, a second switching transistor, a third switching transistor and a fourth switching transistor;

the first switching transistor is provided between the power circuit and the first terminal;

the second switching transistor is provided between the first terminal and a ground;

the third switching transistor is provided between the power circuit and the second terminal;

the fourth switching transistor is provided between the second terminal and the ground;

the antenna receives the drive output voltage in the first direction when the first switching transistor and the fourth switching transistor are turned on, and the second switching transistor and the third switching transistor are turned off;

the antenna receives the drive output voltage in the second direction when the second switching transistor and the third switching transistor are turned on, and the first switching transistor and the fourth switching transistor are turned off, the driver circuit includes a first drive transistor, a second drive transistor, a third drive transistor and a fourth drive transistor for turning on and off the first switching transistor, the second switching transistor, the third switching transistor and the fourth switching transistor, respectively;

the modulator circuit includes a carrier wave signal circuit, a modulation circuit and a logic circuit;

the carrier wave signal circuit produces a carrier wave signal in a pulse form of the carrier wave frequency;

the modulation circuit modulates the carrier wave signal in an ON/OFF modulation manner in accordance with the digital baseband signal, and produces a modulated pulse signal including the ON-modulation period and an OFF-modulation period; and the logic circuit converts the modulated pulse signal into four input drive signals for the first to the fourth drive transistors so that only the first and the fourth switching transistors are turned on to apply the drive output voltage to the antenna in the first direction when the modulated pulse signal is at a first signal level in the ON-modulation period of the modulated pulse signal, only the second and the third switching transistors are turned on to apply the drive output voltage to the antenna in the second direction when the modulated pulse signal is at a second signal level in the ON-modulation period of the modulated pulse signal, and all the first to the fourth switching transistors are turned off during the OFF-modulation period of the modulated pulse signal.

2. The radio transmitter device as in claim 1, wherein:

the antenna is a resonant antenna, which includes a coil and a capacitor coupled in series to resonate with each other; and the driver circuit drives the switching circuit at the carrier wave frequency corresponding to a resonance frequency of the resonant antenna.

3. The radio transmitter device as in claim 1, wherein:

the antenna, the power circuit, the switching circuit, the driver circuit and the modulator circuit are provided in a vehicle to control locking/unlocking of a door by radio communication with a portable device.

4. A radio transmitter device comprising:

an antenna for transmitting a radio wave, the antenna having a first terminal and a second terminal;

a power circuit for receiving a battery voltage and supplying a drive output voltage to the antenna;

a switching circuit provided between the power circuit and the antenna for switching over a direction of application of the drive output voltage between a first direction and a second direction, which are from the first terminal to the second terminal and from the second terminal to the first terminal, respectively;

a driver circuit for driving the switching circuit in response to a carrier wave frequency of the radio wave; and a modulator circuit for modulating in an ON/OFF manner an output of the driver circuit by a digital baseband signal of a frequency lower than the carrier wave frequency, wherein the power circuit is a variable power circuit, which includes a command input circuit for inputting a command value of the drive output voltage and a voltage converter circuit for converting the battery voltage to the drive output voltage in accordance with the command value, the command value being variable so that a range of reach of the radio wave transmitted from the antenna is varied in correspondence to the command value, the switching circuit includes an H-bridge circuit of a first switching transistor, a second switching transistor, a third switching transistor and a fourth switching transistor;

the first switching transistor is provided between the power circuit and the first terminal;

the second switching transistor is provided between the first terminal and a ground;

the third switching transistor is provided between the power circuit and the second terminal;

the fourth switching transistor is provided between the second terminal and the ground;

the antenna receives the drive output voltage in the first direction when the first switching transistor and the fourth switching transistor are turned on and the second switching transistor and the third switching transistor are turned off;

the antenna receives the drive output voltage in the second direction when the second switching transistor and the third switching transistor are turned on, and the first switching transistor and the fourth switching transistor are turned off;

the power circuit supplies only the drive output voltage of a positive polarity;

all the first to the fourth switching transistors are N-channel MOSFETs, which have sources connected to a power circuit side and drains connected to a ground side;

the driver circuit drives gates of the N-channel MOSFETs so that the drive output voltage is applied to the antenna in the first and the second directions alternately; and the driver circuit includes a booster circuit for supplying a gate drive voltage to the gates of the N-channel MOSFETs to be turned on, the gate drive voltage being higher by a threshold voltage than an input voltage supplied from the power circuit to a source side.

5. The radio transmitter device as in claim 4, wherein:

the power circuit sets the drive output voltage to be higher than a lowermost limit, which is lower than the gate drive voltage.

6. The radio transmitter device as in claim 4, wherein:

the booster circuit supplies the gate drive voltage, which is higher than the drive output voltage of the power circuit by more than 2.5 V.

7. The radio transmitter device as in claim 6, wherein:

the lowermost limit of the drive output voltage of the power circuit is set to be more than 1.5 V and less than 2.5 V.

8. The radio transmitter device as in claim 5, wherein:

the booster circuit outputs the gate drive voltage at a fixed level, so that a voltage higher by more than the threshold voltage than the lowermost limit is ensured, when the drive output voltage is set to the lowermost limit.

9. The radio transmitter device as in claim 4, wherein:

the booster circuit includes a charge pump circuit.

10. The radio transmitter device as in claim 4, wherein:

the driver circuit includes a first drive transistor, a second drive transistor, a third drive transistor and a fourth drive transistor for turning on and off the first switching transistor, the second switching transistor, the third switching transistor and the fourth switching transistor, respectively;

the modulator circuit includes a carrier wave signal circuit, a modulation circuit and a logic circuit;

the carrier wave signal circuit produces a carrier wave signal in a pulse form of the carrier wave frequency;

the modulation circuit modulates the carrier wave signal in an ON/OFF modulation manner in accordance with the digital baseband signal, and produces a modulated pulse signal including the ON-modulation period and an OFF-modulation period;

the logic circuit converts the modulated pulse signal into four input drive signals for the first to the fourth drive transistors so that only the first and the fourth switching transistors are turned on to apply the drive output voltage to the antenna in the first direction when the modulated pulse signal is at a first signal level in the ON-modulation period of the modulated pulse signal, only the second and the third switching transistors are turned on to apply the drive output voltage to the antenna in the second direction when the modulated pulse signal is at a second signal level in the ON-modulation period of the modulated pulse signal, and all the first to the fourth switching transistors are turned off during the OFF-modulation period of the modulated pulse signal;

the first and the second drive transistors receive first and second drive voltages, respectively, which are opposite in level and lower than the gate drive voltage;

each of the first and the second drive transistors includes an ON-drive transistor and an OFF-drive transistor;

the ON-drive transistor is connected between the booster circuit and the gate of a corresponding N-channel MOSFET to turn on and off for applying and interrupting the gate drive voltage to the gate of the corresponding N-channel MOSFET, when the input drive voltage is at the first level and the second level, respectively; and the OFF-drive transistor is connected between the gate of a corresponding N-channel MOSFET and the ground to turn off and on for interrupting and connecting the gate of the corresponding N-channel MOSFET to the ground, when the input drive voltage is at the first level and the second level, respectively.

11. The radio transmitter device as in claim 10, wherein:

the driver circuit is operated with a stabilized voltage lower than the battery voltage; and the booster circuit boosts the stabilized voltage to the gate drive voltage.

12. The radio transmitter device as in claim 10, wherein:

the third and the fourth drive transistors receive third and fourth drive voltages, respectively, which are opposite in level and lower than the gate drive voltage;

each of the third and the fourth drive transistors includes an ON-drive transistor and an OFF-drive transistor;

the ON-drive transistor is connected between a gate drive voltage circuit and the gate of a corresponding N-channel MOSFET to turn on and off for applying and interrupting the gate drive voltage of the gate drive voltage circuit to the gate of the corresponding N-channel MOSFET, when the input drive voltage is at the first level and the second level, respectively; and the OFF-drive transistor is connected between the gate of a corresponding N-channel MOSFET and the ground to turn off and on for interrupting and connecting the gate of the corresponding N-channel MOSFET to the ground, when the input drive voltage is at the first level and the second level, respectively.

13. The radio transmitter device as in claim 12, wherein:

the booster circuit outputs the gate drive voltage at a fixed level, so that a voltage higher by more than the threshold voltage than the lowermost limit is ensured, when the drive output voltage is set to the lowermost limit; and the ON-drive transistor of the third and the fourth transistors receives the battery voltage to be applied to the gate of the corresponding N-channel MOSFET.

* * * * *